US007168983B2

(12) United States Patent
Graf et al.

(10) Patent No.: US 7,168,983 B2
(45) Date of Patent: Jan. 30, 2007

(54) HIGH VOLTAGE CONNECTOR ARRANGEMENT

(75) Inventors: Richard Graf, Unterschlelsshelm (DE); Norbert Emil Schad, Hohenlinden (DE)

(73) Assignee: Tyco Electronics Raychem GmbH, Ottobrunn (DE)

( * ) Notice: Subject to any disclaimer, the term of this patent is extended or adjusted under 35 U.S.C. 154(b) by 0 days.

(21) Appl. No.: 11/196,208

(22) Filed: Aug. 3, 2005

(65) Prior Publication Data

US 2006/0030211 A1 Feb. 9, 2006

(30) Foreign Application Priority Data

Aug. 6, 2004 (GB) ..... 0417596.4

(51) Int. Cl.
*H01R 13/58* (2006.01)

(52) U.S. Cl. ..... 439/606

(58) Field of Classification Search ..... 439/606, 439/181–187, 921, 607, 271; 174/27 R, 174/73.1

See application file for complete search history.

(56) References Cited

U.S. PATENT DOCUMENTS 3,835,439 A 9/1974 Yonkers
6,594,133 B1 * 7/2003 Schmidt et al. ..... 361/117

FOREIGN PATENT DOCUMENTS

CH 690 215 A5 5/2000
GB 1 242 068 8/1971

OTHER PUBLICATIONS

RSTI Screened, separable connection system 630 A up to 24 kV (6 pages), Tyco Electronics, Apr. 2001.

* cited by examiner

*Primary Examiner*—Alexander Gilman
(74) *Attorney, Agent, or Firm*—Barley Snyder LLC

(57) ABSTRACT

The present invention provides a high voltage connector arrangement comprising an elongate electrically insulated module, which may be an insulated and screened surge arrester module, and an insulated connector for connecting the module to electrical equipment, which may be switchgear. The arrangement may be such that components of the module are protected from excess current flow therethrough, or the electrical field at the connector end of the conductive layer screen of the module is reduced. In an embodiment, the arrangement can achieve both of these results. The protection of the module is achieved by placing an electrode of the module within an insulated, and advantageously screened, arm of the connector adjacent the end of the conductive layer screen of the module. The electrode may comprise the electrode at one end of the module or may be spaced therefrom, for example by a component of the module. The electrical field stress may be reduced by suitable shaping of the electrode at the end of the conductive layer screen of the module.

13 Claims, 4 Drawing Sheets

HIGH VOLTAGE CONNECTOR ARRANGEMENT

FIELD OF THE INVENTION

This invention relates to a high voltage connector arrangement, and finds particular, though not exclusive, application to the connection of a surge arrester to electrical switchgear.

BACKGROUND

It is known to provide an L-, or T-, shaped insulated connector for connecting a cable termination, for example, to electrical equipment, such as switchgear for example. At high voltage, say above about 15 kV, and above 24 kV in particular, it is also known to screen such connectors by providing an electrically conductive layer on the outer surface thereof for use with a termination for a screened cable. Such a screened connector is available under the trade name RSTI from Tyco Electronics Raychem GmbH. Screening has the advantages of rendering connectors touch proof and of allowing several connectors, for example one for each phase of a three-phase power supply, to be mounted more closely together, thus reducing the size of the cabinet in which they are contained.

Difficulties have been encountered however, in producing a suitable high voltage connector arrangement for certain electrical devices, such as surge arresters. Whilst surge arresters employing air gaps are known, surge arresters using varistor, and especially metal oxide varistor (MOV), blocks are commonly used. Typically such a surge arrester comprises a plurality of substantially solid cylindrical blocks of MOV material compressed in end-to-end relationship between a pair of cylindrical metal electrodes, all sealingly encased within an insulating housing, for example of silicone polymer. A conductive layer is then applied to the outer polymer surface of the housing to provide the required screening.

Referring to FIG. 1, a known high voltage connector arrangement comprises a T-shaped screened connector 2 and an elongate cylindrical surge arrester module 4. The connector 2 comprises an insulating housing 5 of silicone polymer that defines a transverse passageway 6, and a further passageway 8 extending at right angles thereto. The passageway 6 is terminated at one end by a flange 10 for mounting the connector 2 onto a bushing of switchgear (not shown). The other end of the passageway 6 is closed by a cap 12.

The surge arrester module 4 comprises a lower electrode 14, an upper electrode 16, and a plurality of varistor blocks 18, such as MOV blocks for example, extending end to end between the electrodes. The electrode and varistor block structure is held together longitudinally in compression (by means not shown) and is enclosed within silicone rubber insulation 20, with a lower terminal 22 protruding therefrom and a connecting lug 24 protruding from the upper electrode 16. It should be understood that while the insulation 20 is described here as being silicone rubber, other suitable materials having desirable insulating properties for a particular application may be used instead. The surge arrester module 4 is push-fitted into a connector arm 26 of the housing 5 of the connector 2 that contains the passageway 8, such that the connecting lug 24 projects into the passageway 6 and is secured therein to a metal plate 28 by a transverse bolt 30. The housing 5 is electrically screened by means of a conductive layer 32 on the outer surface thereof, which is connected to a terminating pigtail 34 for connection to an earth ground. The surge arrester module 4 is also screened by a conductive layer 36 that extends from the lower end thereof and terminates partway along the stack of varistor blocks 18 at its upper end termination 38 within the connector arm 26. The location within the connector arm 26 of the upper end termination 38 of the conductive layer 36 is typically 5 to 10 mm from the end of the connector arm 26, thus providing a working tolerance to ensure that the conductive layer 36 is enclosed by the connector arm 26.

A conductive layer 40 extends around the inside of the passageway 8 so as to enclose the connecting lug 24 of the surge arrester module 4 within a Faraday Cage.

In operation, the flange 10 of the connector 2 is mounted onto a bushing of the switchgear, thereby establishing an electrical connection via the bolt 30 to the surge arrester module 4.

However, it has been found that with this arrangement operating at high voltage, the electrical field at the upper end termination 38 of the conductive layer 36, within the screened insulated connector arm 26 of the connector 2, can be unacceptably high. A discontinuity in the electrical field distribution arises at the end of the conductive layer 36 within the connector, resulting in an unacceptably high electrical field at the interface between the surge arrester module 4 and the connector 2. Furthermore, it has been found that the short circuit current performance is poor, allowing a high current to flow between the upper electrode 16 and the lower electrode 14 through the varistor blocks 18. In the event of high current flowing through the arrangement, a resulting electric arc passes between one electrode 16 of the surge arrester module 4 to the other electrode 14 through the varistor blocks 18. Under these circumstances, at sufficiently high energy, the surge arrester module 4 can fail explosively and unacceptably.

SUMMARY

It is an object of the present invention to provide a high voltage connector arrangement having improved performance for connecting a screened electrical module, such as a surge arrester, to electrical equipment, such as switchgear.

The present invention provides a high voltage connector arrangement comprising an elongate electrically insulated module, which may be an insulated and screened surge arrester module, and an insulated connector for connecting the module to electrical equipment, which may be switchgear. The arrangement may be such that components of the module are protected from excess current flow therethrough, or the electrical field at the connector end of the conductive layer screen of the module is reduced. In an embodiment, the arrangement can achieve both of these results. The protection of the module is achieved by placing an electrode of the module within an insulated, and advantageously screened, arm of the connector adjacent the end of the conductive layer screen of the module. The electrode may comprise the electrode at one end of the module or may be spaced therefrom, for example by a component of the module. The electrical field stress may be reduced by suitable shaping of the electrode at the end of the conductive layer screen of the module.

In accordance with one aspect of the present invention, there is provided a high voltage connector arrangement having an elongate electrically insulated module, and an insulated connector for connecting the module to electrical equipment. The module comprises an electrical component and an electrode at each end of and in contact with the component. The component and the electrodes are enclosed within electrically insulating material. A conductive layer is applied over the insulating material so as to extend from one end of the module to enclose one of the electrodes and the component and to overlap the other electrode, thereby extending only partway along the length of the module. The module is sealingly inserted in an electrically insulating arm of the connector such that an exposed portion of insulating material and a portion of the conductive layer of the module are enclosed within the connector and such that the insulating arm of the connector overlaps the conductive layer overlapping of the module.

BRIEF DESCRIPTION OF THE DRAWINGS

A high voltage connector arrangement in accordance with the present invention will now be described, by way of example, with reference to the accompanying drawings, in which.

DETAILED DESCRIPTION OF THE EMBODIMENTS

Figure 1:
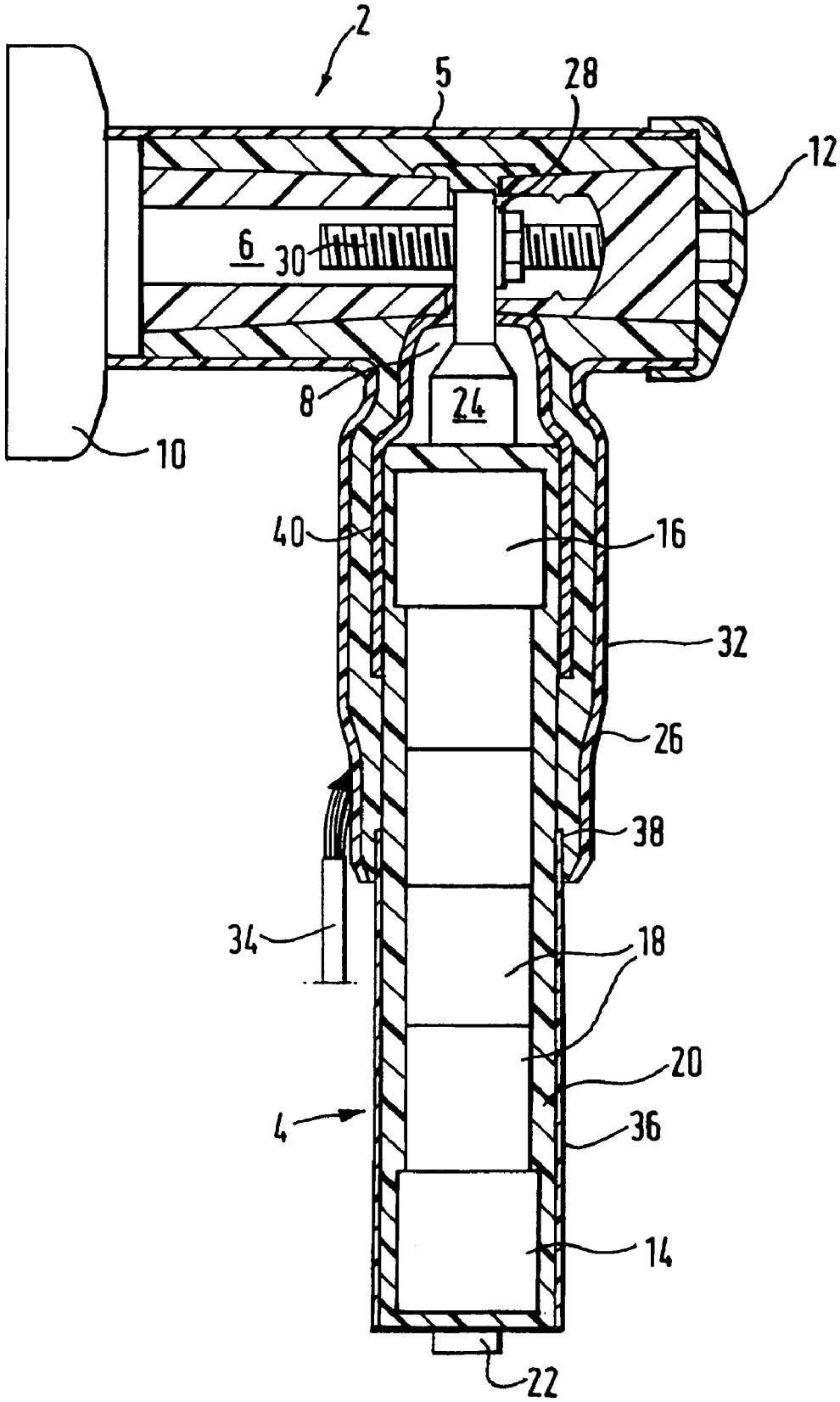
Fig.1.(PRIOR ART)
FIG. 1 is a sectional elevation of a conventional connector arrangement including a varistor surge arrester.

Embodiments of the invention will now be described in further detail. Describing a first embodiment, reference will be made to FIG. 2, which shows modifications to the arrangement of the connector of FIG. 1 that overcome, or at least alleviate, the problems discussed above. Where applicable, the same reference numerals are employed.

The surge arrester module 50, has similar lower and upper electrodes 14 and 16 respectively and the stack of varistor blocks 18, with an additional electrode 52 introduced between the upper varistor block 18 and the upper electrode 16, compressively longitudinally retained therebetween. The surge arrester module 50 and the electrodes 14, 16 are generally cylindrical. The positioning of the upper electrode 16 within the connector 2 is substantially the same as with the known arrangement shown in FIG. 1. The additional electrode 52 extends downwardly within the surge arrester module 50 so as to dispose its lower end 54 within that portion of the insulation 20 that is enclosed within the conductive layer 36. By this means, the electrical field at the upper end termination 38 of the conductive layer 36 can be significantly reduced. The reduction of the field in this region is achieved by providing the upper portion of the lower end 54 of the electrode 52 with an inwardly directed shoulder 56 that leads to a narrowed electrode portion 58 that then tapers outwardly at a tapered shoulder 60 to the upper end 62 of the additional electrode 52. As can be seen from FIG. 2, the tapered shoulder 60 at the upper end of electrode 52 lies within the region of the lower termination of the conductive layer 40 within the Faraday Cage of the connector 2, thus reducing the electrical field strength and electrical stress in that region of the connector arrangement.

Figure 2:
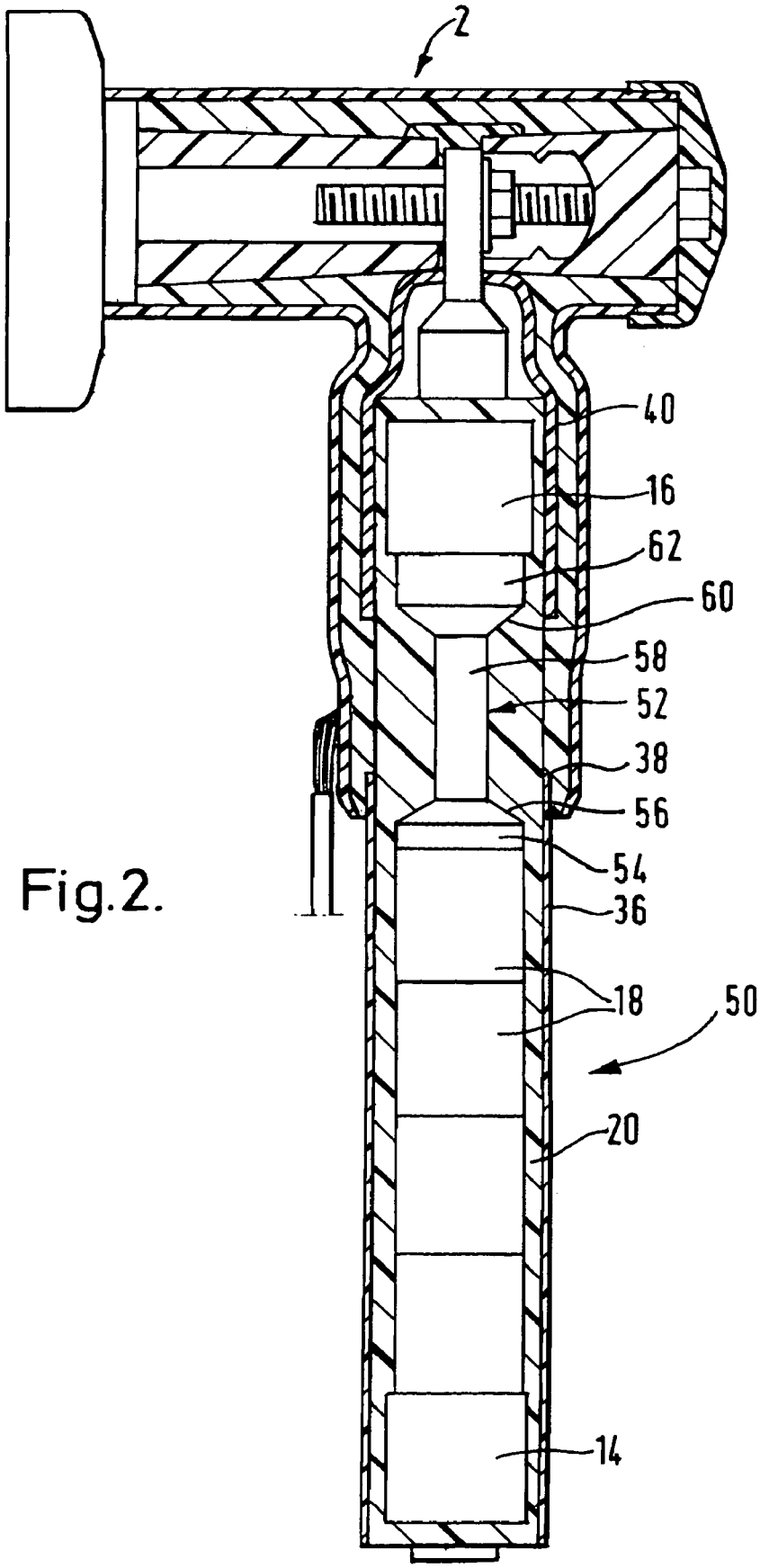
FIG. 2 is a sectional elevation of a first embodiment of a connector arrangement in accordance with the present invention.

The arrangement shown in FIG. 2 has the advantage of improving the short circuit performance. Under conditions of short circuit, when a large current is applied to the arrangement, it has been found that the current flows from the upper electrode 16, through the additional electrode 52, and thence, rather than directly through the varistor blocks 18, outwardly through the insulation 20, to and along the conductive layer 36, and thence back through the insulation 20 at its lower end onto the lower electrode 14. Whilst this can itself still lead to explosive failure of the connection arrangement, the explosive effect is significantly less drastic than with the arrangement of FIG. 1, giving rise to an acceptable failure mode.

Although in the FIG. 2 embodiment, the additional electrode 52 is shown as a separate component from the upper electrode 16, it is envisaged that these could be formed as a single structure.

Furthermore, if the additional electrode 52 were not tapered, but rather were a right cylindrical extension of the electrode 16, integral therewith or not, then it will be appreciated that such an arrangement would still produce the short circuit protection for the varistor blocks of the module 50, as a result of its positioning adjacent the upper end termination 38 of the conductive layer 36.

Figure 3:
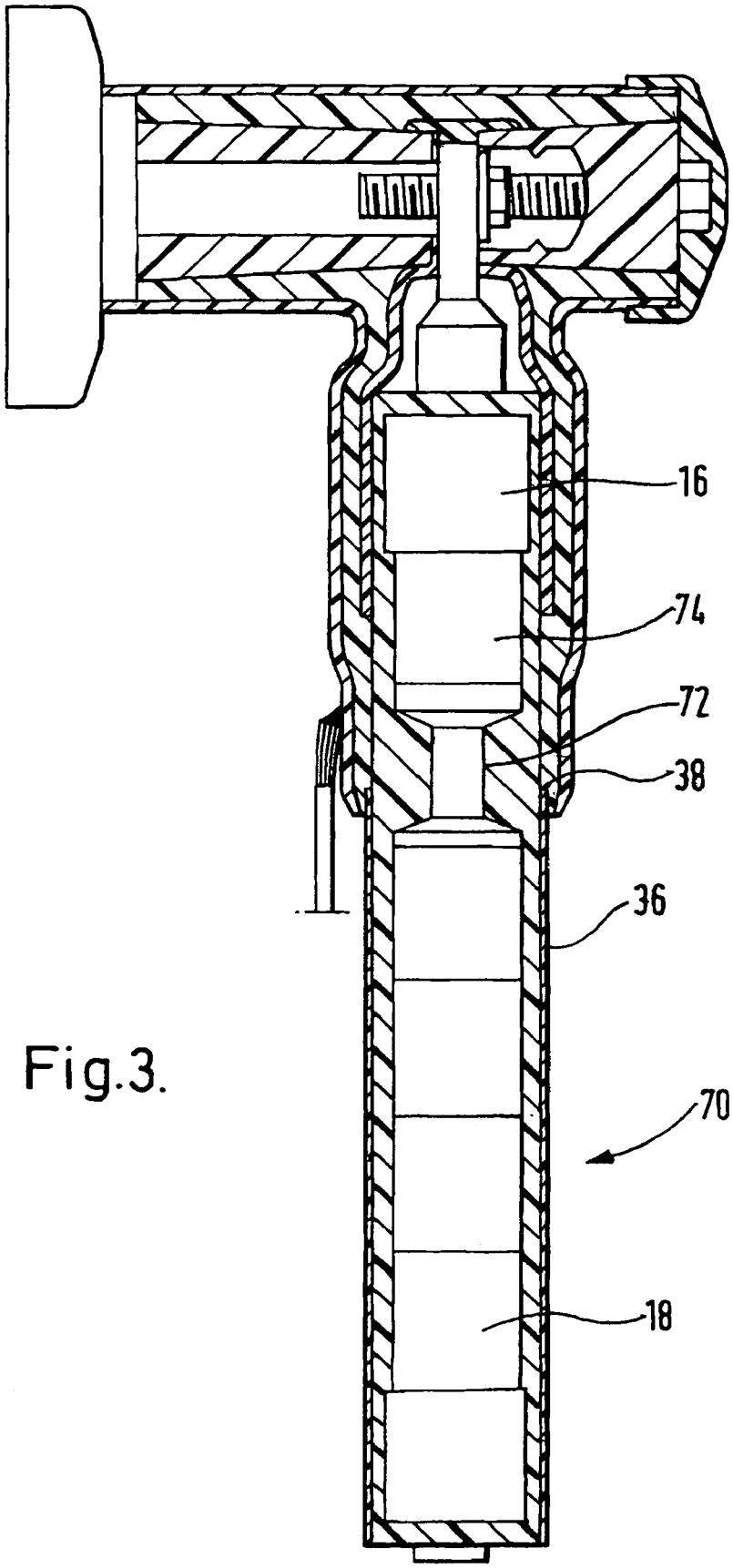
FIG. 3 is a sectional elevation of a second embodiment of a connector arrangement in accordance with the present invention.

FIG. 3 shows a second embodiment including modification of the arrangement of FIG. 2, in that a surge arrester module 70 is provided with an additional upper electrode 72 that is of the same general configuration as the additional electrode 52 of the FIG. 2 embodiment, except in so far as it does not extend longitudinally from the upper end of the stack of varistor blocks 18 all the way to the upper electrode 16, but is spaced therefrom by the interpositioning of a further varistor block 74. It will be appreciated that the control of the electrical stress at the upper end termination 38 of the conductive layer 36 and the enhanced short circuit performance of the surge arrester module 70 is effected in the same way as previously, resulting from the similar location of the additional electrode 72.

Figure 4:
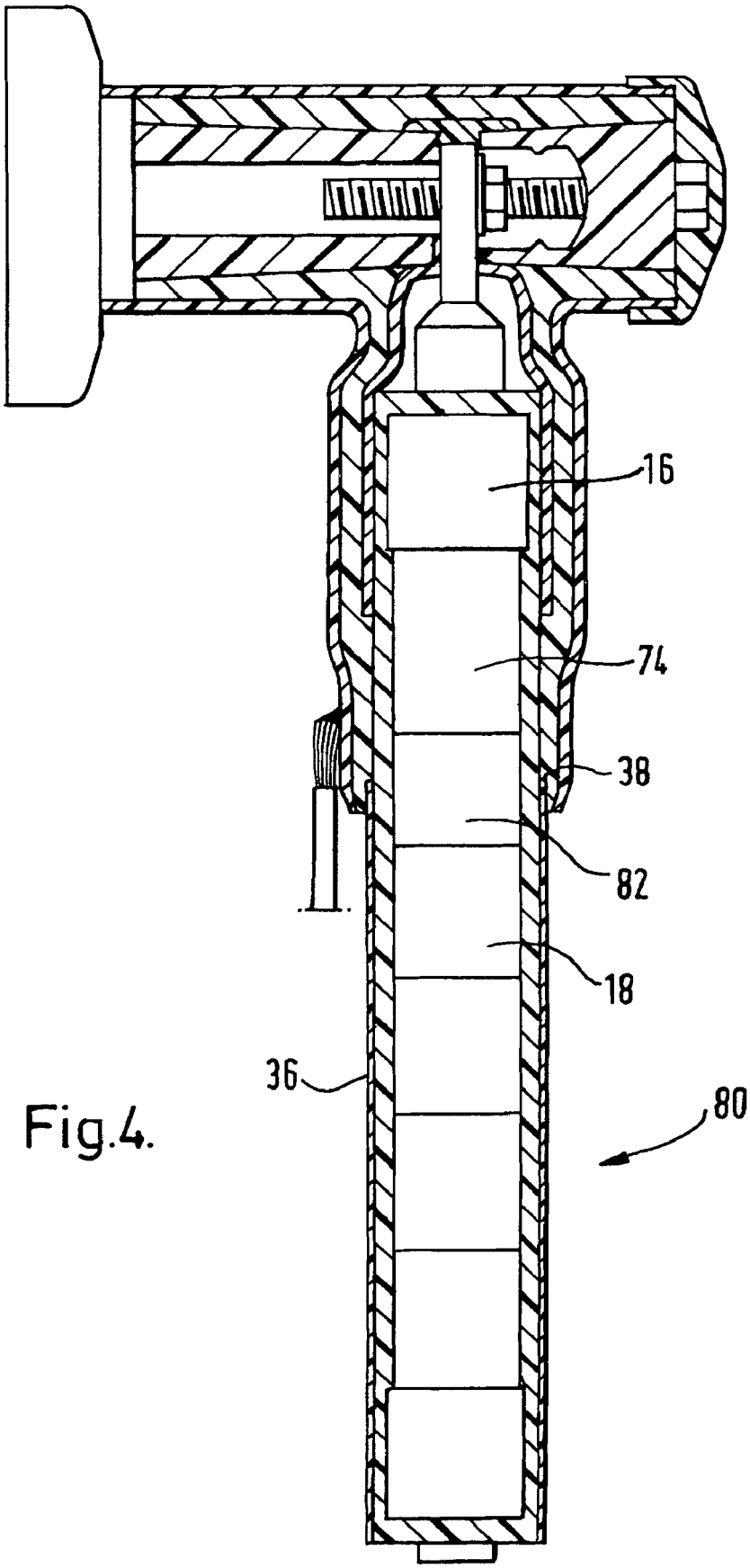
FIG. 4 is a sectional elevation of a third embodiment of a connector arrangement in accordance with the present invention.

FIG. 4 shows a further embodiment of the invention, in which a surge arrester module 80 is provided with an intermediate additional electrode 82, again longitudinally spaced by a further varistor block 74 from the upper electrode 16, but in which the intermediate electrode 82 is of a substantially right cylindrical configuration, thus providing for the short circuit protection of the varistor blocks 18 of the module 80 due to the positioning of the electrode 82 adjacent the upper end termination 38.

Although the present invention has been particularly exemplified with reference to a surge arrester, it is envisaged that the electrical module may have other functions and, for example, could be provided as a monitoring module.

Advantageously, in the arrangement of the present invention, the positioning of the upper electrode 16 is such that short circuit current is encouraged to pass from that electrode 16, through the adjacent wall of the insulation 20 of the module to its conductive layer 36 and hence to the lower electrode 14, rather than passing through the varistor blocks 18 or component in the interior of the module.

Advantageously the shaping of an additional electrode 52, 72 reduces electrical stress within the connector in the region of the module, and particularly at the enclosed upper end termination 38 of the conductive layer 36, and preferably comprises an inwardly-directed tapering thereof.

Advantageously, the sealing engagement of the module within the connector 2 can be achieved as a push-fit, allowing for convenient demountability when required.

What is claimed is:

1. A high voltage connector arrangement comprising:

an elongate electrically insulated module, and an insulated connector for connecting the module to electrical equipment, wherein the module comprises an electrical component and an electrode at each end of and in contact with the electrical component, the electrical component and the electrodes being enclosed within electrically insulating material, a conductive layer being applied over the insulating material so as to extend from one end of the module to enclose one of the electrodes and the electrical component and to overlap the other electrode, thereby extending only partway along the length of the module, wherein the module is sealingly inserted in an electrically insulating arm of the connector such that an exposed portion of insulating material and a portion of the conductive layer of the module are enclosed within the connector and such that the insulating arm of the connector overlaps the conductive layer overlapping of the module, and wherein the other electrode is tapered inwardly from the module away from its outer surface in the region of the overlap so as to reduce electrical stress.

2. An arrangement according to claim 1, wherein the other electrode tapers inwardly from each end thereof to a narrower intermediate section.

3. An arrangement according to claim 1, wherein the other electrode is formed of two parts, having shaping in one part, and a uniform cross-section being located at the end of the module in the other part.

4. A high voltage connector arrangement comprising:

an elongate electrically insulated module, and an insulated connector for connecting the module to electrical equipment, wherein the module comprises an electrical component and an electrode at each end of and in contact with the electrical component, the electrical component and the electrodes being enclosed within electrically insulating material and a conductive layer being applied over the insulating material so as to extend from one end of the module to enclose one of the electrodes and the electrical component and to overlap the other electrode, thereby extending only partway along the length of the module, wherein the other electrode extends longitudinally away from the electrical component and is shaped so as to reduce electrical stress at the end of the conductive layer, wherein the module is sealingly inserted in an electrically insulating arm of the connector such that an exposed portion of the insulating material and a portion of the conductive layer of the module are enclosed within the connector such that the insulating arm thereof overlaps the conductive layer overlap, and wherein the module comprises a further electrical component and a further electrode enclosed within the insulating material, wherein the further electrode is disposed at the end of the module remote from the one end, and wherein the further electrical component is disposed between the further electrode and the other electrode.

5. An arrangement according to claim 4, wherein the other electrode extends beyond the end of the arm of the connector.

6. An arrangement according to claim 4, wherein at least the electrically insulating arm of the connector has an electrically conductive outer surface.

7. An arrangement according to claim 4, wherein the module and the arm of the connector are of generally cylindrical construction.

8. An arrangement according to claim 4, wherein shaping of the other electrode comprises a reducing of the transverse dimension of the other electrode away from the electrical component.

9. An arrangement according to claim 8, wherein the reducing of the transverse dimension of the other electrode comprises a gradual tapering thereof.

10. An arrangement according to claim 4, wherein the electrical module comprises a surge arrester.

11. An arrangement according to claim 10, wherein the electrical component of the module comprises a metal oxide varistor.

12. A method of reducing electrical stress at the end of a conductive layer of an elongate electrically insulated module that is sealingly mounted in an insulated connector for connection to electrical equipment, comprising:

applying an insulating material to the module so as to surround an electrode at each end thereof and an electrical component that extends between the electrodes, a further electrical component and a further electrode being enclosed within the insulating material, the further electrode being disposed at the end of the module remote from the other end, and the further electrical component being disposed between the further electrode and the other electrode, applying a conductive layer to the module on top of the insulating material so as to extend from enclosing the electrode at one end thereof to enclose the electrical component and to terminate partway along enclosing the other electrode, and inserting the module into the connector such that the insulation of the connector overlaps the conductive layer on the module.

13. A method of reducing electrical stress at the end of a conductive layer of an elongate electrically insulated module that is sealingly mounted in an insulated connector for connection to electrical equipment, comprising:

applying insulating material to the module so as to surround an electrode at each end thereof and an electrical component that extends between the electrodes, applying a conductive layer to the module on top of the insulating material so as to extend from enclosing one electrode at one end thereof to enclose the electrical component and to terminate partway along enclosing the other electrode, and shaping the other electrode so it extends longitudinally away from the electrical component to reduce electrical stress at the adjacent end of the conductive layer on the module, the other electrode being tampered inwardly from the module away from its outer surface.

* * * * *